United States Patent [19]

Baba et al.

[11] Patent Number: 4,818,676

[45] Date of Patent: Apr. 4, 1989

[54] SILVER HALIDE PHOTOGRAPHIC EMULSION

[75] Inventors: Susumu Baba; Eigi Matsubara; Katsuaki Iwaosa; Akira Tanaka, all of Nagaokakyo, Japan

[73] Assignee: Mitsubishi Paper Mills, Ltd., Tokyo, Japan

[21] Appl. No.: 905,449

[22] Filed: Sep. 10, 1986

[30] Foreign Application Priority Data

| | | | |
|---|---|---|---|
| Sep. 12, 1985 | [JP] | Japan | 60-202622 |
| Sep. 12, 1985 | [JP] | Japan | 60-202623 |
| Sep. 12, 1985 | [JP] | Japan | 60-202624 |

[51] Int. Cl.[4] ..... G03C 1/19

[52] U.S. Cl. ..... 430/574; 430/572; 430/587

[58] Field of Search ..... 430/574, 572, 587

[56] References Cited

U.S. PATENT DOCUMENTS

| | | | |
|---|---|---|---|
| 2,126,078 | 8/1938 | Zeh et al. | 430/587 |
| 3,527,641 | 9/1970 | Nakazawa et al. | 430/574 |
| 3,793,031 | 2/1974 | Shiba et al. | 430/574 |
| 4,326,023 | 4/1982 | DeSeyn | 430/574 |
| 4,622,290 | 11/1986 | Tanaka et al. | 430/574 |

*Primary Examiner*—Paul R. Michl
*Assistant Examiner*—Mark R. Buscher
*Attorney, Agent, or Firm*—Cushman, Darby & Cushman

[57] ABSTRACT

Disclosed is a silver halide photographic emulsion supersensitized with at least two sensitizing dyes selected from those represented by the following general formula [I], [II] and [III]:

General formula [I]:

wherein $R_1$ represents an unsubstituted or substituted alkyl group, $R_2$ represents a sulfoalkyl group or a sulfoaralkyl group, and $R_3$ represents an alkyl group, and $W_1$ and $W_2$ represent each an alkylene group;

General formula [II]:

wherein $W_3$ to $W_6$ represent each an alkyl group, an alkoxy group, or hydroxyl group, $R_4$ represents an unsubstituted or substituted alkyl group, $R_5$ represents a sulfoalkyl group or a sulfoaralkyl group, and $R_6$ represents an alkyl group;

General formula [III]:

wherein $R_7$ represents an unsubstituted or substituted alkyl group, $R_8$ represents a sulfoalkyl group or a sulfoaralkyl group, $R_9$ represents an alkyl group, and $W_7$ and $W_8$ represent each an alkyl group, an alkoxy group, or hydroxyl group.

7 Claims, No Drawings

SILVER HALIDE PHOTOGRAPHIC EMULSION

BACKGROUND OF THE INVENTION

This invention relates to a silver halide photographic emulsion and, more particularly, to a silver halide photographic emulsion supersensitized with a combination of at least two sensitizing dyes to impart a high red sensitivity.

Silver halide photosensitive materials are each required to be highly sensitive to a particular wavelength region of the spectrum depending upon each purpose of use. It is well known that as one of the techniques to produce such photosensitive materials, a certain type of sensitizing dye is added to the silver halide emulsion to enhance effectively the sensitivity to a specific region of the spectrum where the wavelengths are longer than those of the region in which the silver halide exhibits intrinsic sensitivity. It is also known that when used in combination with another sensitizing dye or a special organic compound, such a sensitizing dye imparts to the emulsion a sensitivity larger than the sum of sensitivities imparted by each sensitizing dye or organic compound alone. Such an effect is called "supersensitization", and many combinations have already been reported. Since the silver halide photographic sensitive materials in recent years are required to be more sensitive, it is important to develop a technique for performing the spectral sensitization more effectively. In order to produce photosensitive materials of high sensitivity, it is advantageous to use a combination of at least two types of sensitizing dyes which are in supersensitizing interrelationships and which do not accompany densensitizing effect.

Furthermore, with the rapid progress in optoelectronics, laser beams and light rays from LED are used as light source in place of conventional incandescent lamps in image processing by the electrooptical conversion of signal current. Particularly, wavelengths of the rays emitted from He-Ne laser, ruby laser, and red LED are in the spectral region of from 600 to 700 nm. For the sensitive materials used to record such red rays, conventional supersensitizing combinations are insufficient in sensitivity.

SUMMARY OF THE INVENTION

An object of the present invention is to provide a supersensitized silver halide photographic emulsion having a high sensitivity to the red wavelength region.

DESCRIPTION OF THE INVENTION

The object of this invention has been achieved by the supersensitizing effect exhibited by the silver halide photographic emulsion containing at least two of the three sensitizing dyes represented by the following general formula [I], [II] and [III]:

General formula [I]:

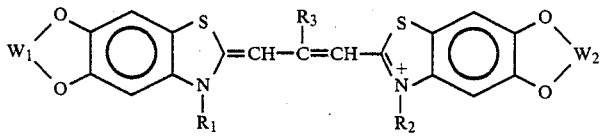

[I]

wherein $R_1$ represents an unsubstituted alkyl group such as, for example, a lower alkyl group such as methyl, ethyl, propyl, or pentyl group; or a substituted alkyl group such as β-hydroxyethyl, γ-hydroxypropyl, β-acetoxyethyl, β-benzoyloxyethyl, γ-acetoxypropyl, β-methoxyethyl, γ-methoxypropyl, carboxymethyl, β-carboxyethyl, γ-carboxypropyl, methoxycarbonylmethyl, ethoxycarbonylmethyl, β-methoxycarbonylethyl, γ-methoxycarbonylpropyl, β-sulfoethyl, γ-sulfopropyl, γ-sulfobutyl, δ-sulfobutyl, allyl, benzyl, phenethyl, or p-sulfobenzyl group; when the dye is a sulfoanionic type, one of the sulfonic acid may be in the form of alkali metal salt (e.g. potassium salt, sodium salt, etc.) or ammonium salt (e.g. ammonium salt, triethylammonium salt, or pyridinium salt);

$R_2$ represents a sulfoalkyl group (e.g. β-sulfoethyl, γ-sulfopropyl, γ-sulfobutyl, or δ-sulfobutyl group), or a sulfoaralkyl group (e.g. sulfobenzyl or sulfophenethyl group);

$R_3$ represents a lower alkyl group such as methyl, ethyl, or butyl group;

$W_1$ and $W_2$ represent each an alkylene group such as, for example, methylene, ethylene, or propylene group;

General formula [II]:

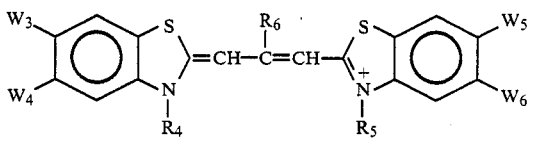

[II]

wherein $W_3$ to $W_6$ represent each an alkyl group such as a lower alkyl group (e.g., those of $R_1$ in general formula [I]), an alkoxy group (e.g. methoxy, ethoxy, propoxy, or butoxy group), or hydroxyl group;

$R_4$ represents an unsubstituted or substituted alkyl group such as those of $R_1$ in general formula [I]; when the dye is a sulfoanionic type, one of the sulfonic acid may be in the form of alkali metal salt (e.g. potassium salt, sodium salt, etc.) or ammonium salt (e.g. ammonium salt, triethylammonium slat, or pyridinium salt);

$R_5$ represents a sulfoalkyl group or a sulfoaralkyl group such as those of $R_2$ in general formula [I];

$R_6$ represents a lower alkyl group such as methyl, ethyl, or butyl group;

General formula [III]:

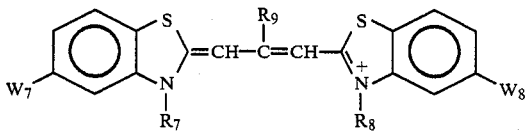

[III]

wherein $R_7$ represents an unsubstituted or substituted alkyl group such as those of $R_1$ in general formula [I];

when the dye is a sulfoanionic type, one of the sulfonic acid may be in the form of alkali metal salt (e.g. potassium salt, sodium salt, etc.) or ammonium salt (e.g. ammonium salt, triethylammonium salt, or pyridinium salt);

$R_8$ represents a sulfoalkyl group or a sulfoaralkyl group such as those of $R_2$ in general formula [I];

$R_9$ represents a lower alkyl group such as methyl, ethyl or butyl group;

$W_7$ and $W_8$ represent each an alkyl group (e.g. a lower alkyl group such as those of $R_1$ of general formula [I]), an alkoxy group (e.g. methoxy, ethoxy, propoxy, butoxy, pentyloxy, benzyloxy, or phenethyloxy), or hydroxyl group.

Examples of the particular sensitizing dyes represented by the general formula [I], [II] or [III] are listed below, but the sensitizing dyes usable in the present invention are not limited thereto.

Examples of sensitizing dyes represented by the general formula [I]:

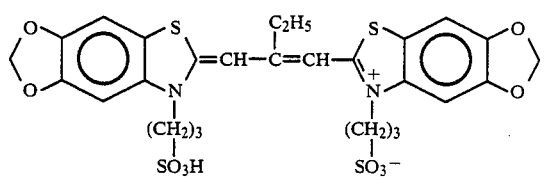

[I-A]

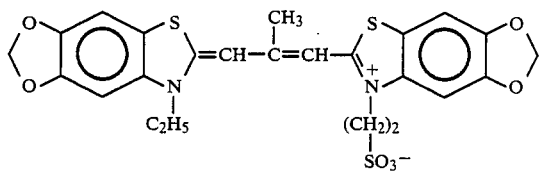

[I-B]

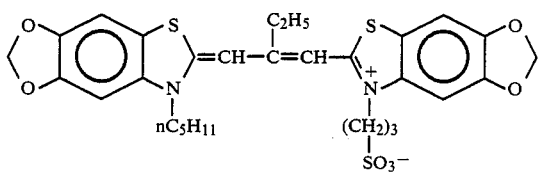

[I-C]

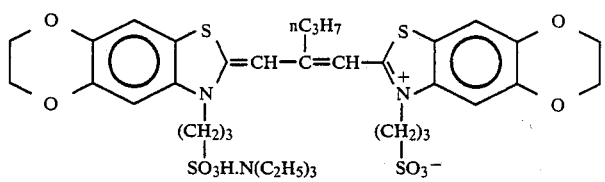

[I-D]

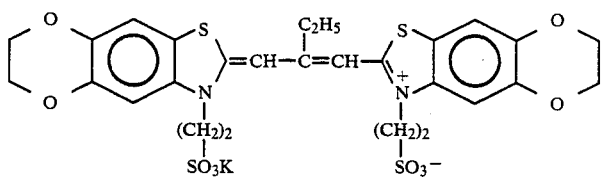

[I-E]

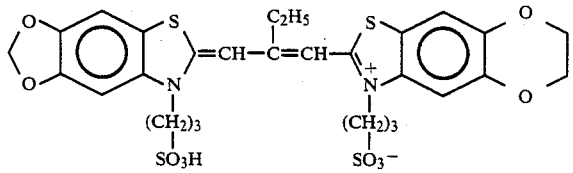

[I-F]

-continued
[I-G]
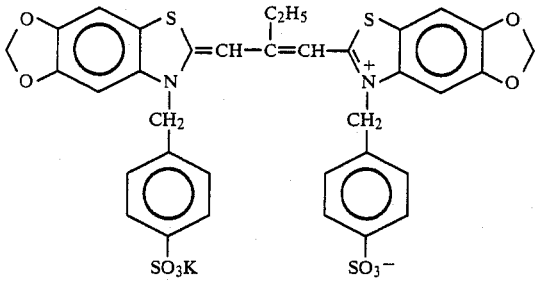
Examples of sensitizing dyes represented by the general formula [II]:
[II-A]
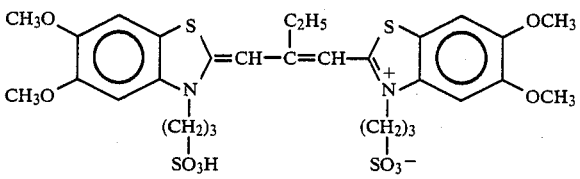
[II-B]
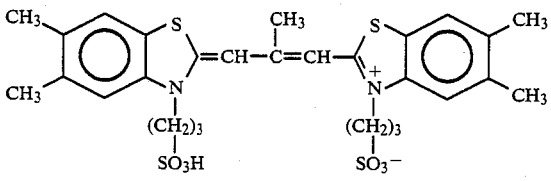
[II-C]
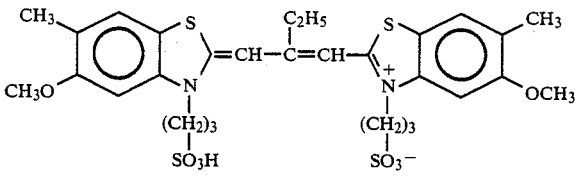
[II-D]
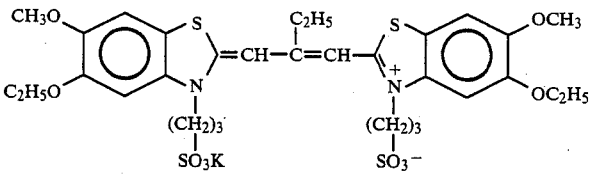
[II-E]
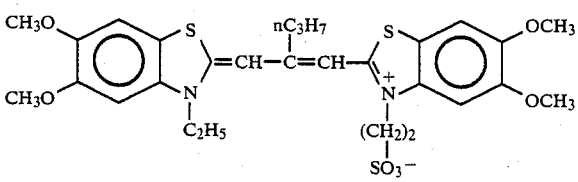

-continued

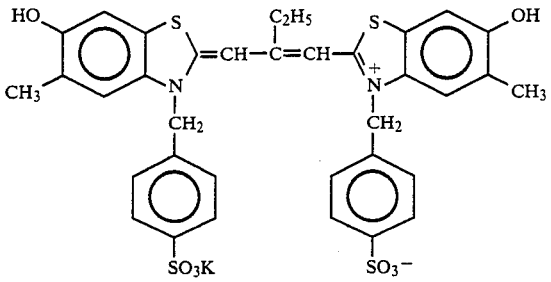

[II-F]

Examples of sensitizing dyes represented by the general formula [III]:

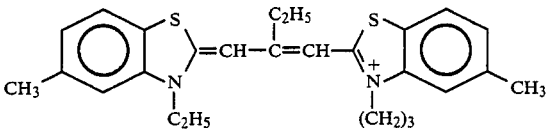

[III-A]

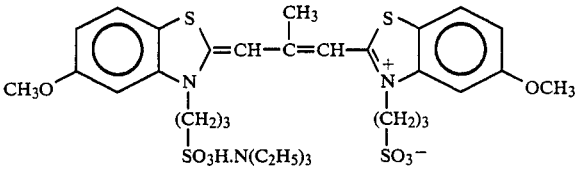

[III-B]

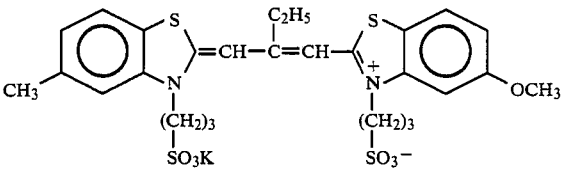

[III-C]

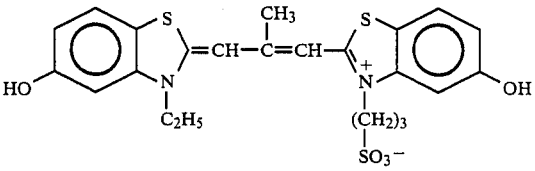

[III-D]

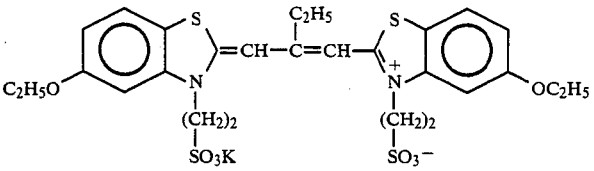

[III-E]

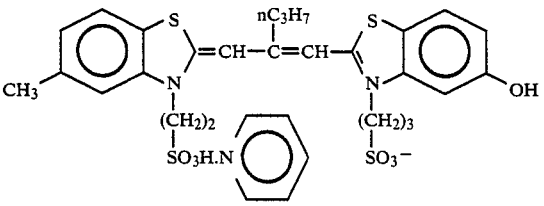

[III-F]

The sensitizing dyes represented by the general formula [I], [II] or [III] are prepared by the known methods. Those who are skilled in the art will easily synthesize these dyes by referring to the documents such as, for example, U.S. Pat. Nos. 2,503,776 and 3,117,210, British Pat. No. 742,112, German Pat. Nos. 929,080 and 1,072,765.

The silver halide photographic emulsion used in this invention can be any of the silver chloride, silver bromide, silver chlorobromide, silver iodobromide, and silver chloroiodobromide emulsions produced by the common methods.

The sensitizing dyes of this invention is added to the emulsion as a solution in suitable solvents such as methanol, isopropanol, pyridine, dimethylformamide, and water, which are used each alone or in mixtures. The dye can also be incorporated into the emulsion by the ultrasonic dispersion technique. It is further possible to incorporate the dye by the methods described in U.S. Pat. Nos. 3,482,981, 3,585,195, 3,469,987, 3,649,286, 3,485,634, 3,342,605, and 2,912,343.

Although variable depending upon the type of dyes or the type of silver halide emulsions, the amount added of the combination of at least two of the three dyes of the formulas [I], [II] and [III] is generally in the range of from 0.01 g to 10 g for 1 kg of the silver halide in terms of silver nitrate; the mixing ratio of dyes in the combination of two dyes is preferably in the range of from 1:0.1–10 in molar ratio and that of dyes in the combination of three dyes is 1:0.1–10:0.1–10 in molar ratio, but, if necessary, other mixing ratios are allowable.

The order of addition of the dyes of formulas [I], [II], and [III] may be optional. It is also possible to add the solution of a mixture of at least two of these dyes.

The silver halide photographic emulsion used in this invention can be noble metal-sensitized, sulfur-sensitized, or reduction-sensitized or admixed with a compound of the polyalkylene oxide type. If necessary, the emulsion may contain other sensitizing dyes such as cyanin dyes or merocyanin dyes, and other additives such as stabilizers, surface active agents, and hardeners.

When used in color photographic sensitive materials, the emulsions of this invention may contain color couplers and the dispersants for the couplers. The emulsion may further contain, in addition to gelatin, other protective colloides such as gelatin derivatives (e.g. phthalated gelatin and malonated gelatin), cellulose derivatives, soluble starch, and water-soluble polymers; and plasticizers to improve the dimensional stability such as, for example, polymer latices. The supports for the emulsion are generally baryta paper, resin coated paper, synthetic paper, and natural or synthetic polymer films of the cellulose triacetate type or polyester type.

The invention is further illustrated in detail below with reference to Examples, but the invention is not limited thereto since many modifications are possible within the scope of appended claims.

EXAMPLE 1

A silver chloride emulsion prepared by the customary method of preparing silver halide photographic emulsions was subjected to the second ripening of sulfur sensitization and the ripened emulsion was divided into several portions. To each portion was added a solution of sensitizing dyes each alone or in combination as shown in Table 1. Each emulsion was left standing at about 40° C. for 45 minutes to stabilize the spectral sensitization. After addition of a stabilizer, coating aid, and a hardener, each emulsion was coated on a polyethylene laminated paper support and dried to prepare test specimens. Each specimen was tested for red sensitivity by using a sensitometer provided with a light source having a color temperature of 5,400° K. and a red filter (Wratten No. 29). The sensitivity maximum was determined from the spectrogram obtained by means of a spectrograph of the diffraction grating type. The specimens were then developed with D-72 developer at 20° C. for 90 seconds. After stopping, fixing, and washing with water, there were obtained strips carrying prescribed black and white images.

Optical densities were measured by means of a densitometer (MACBETH TD-504 of Macbeth Corp., USA) and red light sensitivity and white light sensitivity were obtained. The basis point of optical density in the sensitometry was 0.75. The results obtained were the sensitizing dye I-A was used in an amount of 2 g/m$^2$ was assumed to be 100. The silver coverage was 1.8 g/m$^2$.

TABLE 1

| Specimen No. | Sensitizing dye and amount used (mg/m$^2$) | | | Relative red sensitivity | Fog |
|---|---|---|---|---|---|
| 1 | [I-A] 2 | [II-A] 0 | [III-A] 0 | 100 | 0.11 |
| 2 | [I-A] 1.5 | [II-A] 0.5 | [III-A] 0 | 320 | 0.10 |
| 3 | [I-A] 1 | [II-A] 1 | [III-A] 0 | 490 | 0.10 |
| 4 | [I-A] 0.5 | [II-A] 1.5 | [III-A] 0 | 310 | 0.10 |
| 5 | [I-A] 0 | [II-A] 2 | [III-A] 0 | 116 | 0.10 |
| 6 | [I-A] 3 | [II-A] 0 | [III-A] 0 | 105 | 0.12 |
| 7 | [I-A] 5 | [II-A] 0 | [III-A] 0 | 102 | 0.13 |
| 8 | [I-A] 0 | [II-A] 3 | [III-A] 0 | 109 | 0.12 |
| 9 | [I-A] 0 | [II-A] 5 | [III-A] 0 | 114 | 0.14 |
| 10 | [I-A] 0 | [II-A] 0 | [III-A] 3 | 103 | 0.11 |
| 11 | [I-A] 0 | [II-A] 0 | [III-A] 5 | 106 | 0.11 |
| 12 | [I-A] 0.5 | [II-A] 0.5 | [III-A] 1 | 370 | 0.11 |
| 13 | [I-A] 2 | [II-A] 1 | [III-A] 2 | 560 | 0.11 |

As is apparent from Table 1, as compared with specimen 1, 5, 10 and 11 wherein the sensitizing dye I-A, II-A or III-A was used alone, the specimens 2, 3, 4, 12 and 13 wherein the dyes I-A and II-A or I-A, II-A and III-A were used in combination, showed higher red sensitivities and lower fogs, whereas specimens 6, 7, 8 and 9, wherein the dye I-A or II-A was used in higher amounts, showed substantially no increase in sensitivity but increased fog.

EXAMPLE 2

An emulsion was prepared by using the solutions of the following formulations:

| | |
|---|---|
| Solution V | |
| Phthalated gelatin | 5 g |
| 0.1 N aqueous potassium bromide solution | 20 ml |
| Made up with water to | 200 ml |
| Adjusted with 1 N sulfuric acid to | pH = 5.0 |
| Solution VI | |
| Silver nitrate | 136 g |
| Made up with water to | 400 ml |
| Solution VII | |
| Potassium bromide | 92.8 g |
| Potassium iodide | 3.3 g |
| Phthalated gelatin | 16 g |
| Made up with water to | 400 ml |
| Solution VIII | |
| 6 N sulfuric acid | |

To the solution V maintained at 60° C., were added simultaneously the solutions VI and VII with vigorous stirring over a period of 30 minutes while controlling pAg at 7.4. Five minutes before completion of the mixing, a sensitizing dye shown in Table 2 was added in an amount of 70 mg for 1 mole of silver halide. Solution VIII was added to adjust to pH 3.5, thereby to separate out the emulsion. After washing with water, there was obtained a silver iodobromide emulsion containing 97.5 mol-% of bromide. It was a monodispersed emulsion of cubic crystals of 0.25$\mu$ in average particle size, 95% by weight or more of the particles having a particle size within ±20% of the average value. The emulsion was redispersed, then adjusted to pH 6.5 by the addition of gelatin, and admixed with 40 mg of sodium thiosulfate and 15 mg of ammonium gold thiocyanate for 1 mole of silver halide. The emulsion was allowed to undergo chemical ripening at 55° C. for 60 minutes, and admixed with 300 mg of 1-phenyl-5-mercaptotetrazole per mole of silver halide. To the emulsion, was added a sensitizing dye as shown in Table 2, then followed by a hardener and a surface active agent spent. The resulting emulsion was coated on a polyethylene terephthalate film at a silver coverage of 3.0 g/m$^2$ and dried to prepare test specimens. Each test specimen was treated as in Example 1 and tested for the transmission density. The sensitivity (relative value) and the fog were as shown in Table 2. Sensitizing dyes I-a and II-a were used as reference.

TABLE 2

| Specimen No. | Sensitizing dye and amount used (mg/m$^2$) | | Relative red sensitivity | Fog |
|---|---|---|---|---|
| 1 | [I-B] 4 | [II-B] 0 | 100 | 0.06 |
| 2 | [I-B] 2 | [II-B] 2 | 415 | 0.06 |
| 3 | [I-B] 0 | [II-B] 4 | 87 | 0.06 |
| 4 | [I-C] 4 | [II-C] 0 | 91 | 0.08 |
| 5 | [I-C] 2 | [II-C] 2 | 380 | 0.06 |
| 6 | [I-C] 0 | [II-C] 4 | 83 | 0.06 |
| 7 | [I-D] 4 | [II-D] 0 | 96 | 0.07 |
| 8 | [I-D] 2 | [II-D] 2 | 275 | 0.05 |
| 9 | [I-D] 0 | [II-D] 4 | 84 | 0.05 |
| 10 | [I-E] 4 | [II-E] 0 | 89 | 0.06 |
| 11 | [I-E] 2 | [II-E] 2 | 290 | 0.06 |
| 12 | [I-E] 0 | [II-E] 4 | 104 | 0.06 |
| 13 | [I-F] 4 | [II-F] 0 | 78 | 0.05 |
| 14 | [I-F] 2 | [II-F] 2 | 270 | 0.05 |
| 15 | [I-F] 0 | [II-F] 4 | 94 | 0.06 |
| 16 | [I-a] 2 | [II-B] 2 | 90 | 0.06 |
| 17 | [I-a] 4 | [II-B] 0 | 71 | 0.06 |
| 18 | [I-B] 0 | [II-a] 4 | 82 | 0.06 |
| 19 | [I-B] 2 | [II-a] 2 | 98 | 0.06 |

As is apparent from Table 2, as compared with the specimens No. 1, 3, 4, 6, 7, 9, 10, 12, 13 and 15, wherein sensitizing dyes were used each alone, the specimens No. 2, 5, 8, 11, and 14, wherein sensitizing dyes were used in combinations, showed distinctly higher red sensitivities. The specimens 16 and 19, wherein reference dye I-a was used in combination with sensitizing dye II-B and reference dye II-a in combination with sensitizing dye I-B, showed each a smaller increase in sensitivity compared with the specimens No. 1, 3, 17 and 18, wherein the dyes were used each alone.

Reference dyes:

[I-a]

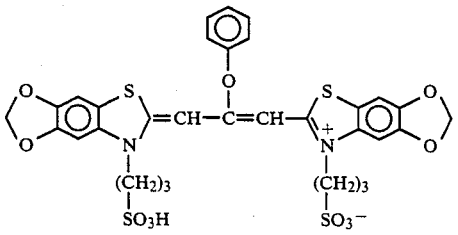

-continued

[II-a]

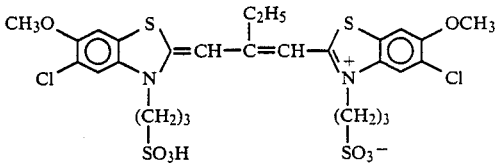

EXAMPLE 3

Specimens were prepared in the same manner as in Example 1, except that sensitizing dyes shown in Table 3 were used. The test results were as shown in Table 3. The red sensitivity was assumed to be 100 when the sensitizing dye III-A was used in an amount of 2 mg/m$^2$. The silver coverage was 1.8 g/m$^2$.

TABLE 3

| Specimen No. | Sensitizing dye and amount used (mg/m$^2$) | | Relative red sensitivity | Fog |
|---|---|---|---|---|
| 1 | [III-A] 2 | [I-A] 0 | 100 | 0.10 |
| 2 | [III-A] 1.5 | [I-A] 0.5 | 155 | 0.10 |
| 3 | [III-A] 1 | [I-A] 1 | 320 | 0.10 |
| 4 | [III-A] 0.5 | [I-A] 1.5 | 180 | 0.10 |
| 5 | [III-A] 0 | [I-A] 2 | 108 | 0.11 |
| 6 | [III-A] 3 | [I-A] 0 | 105 | 0.11 |
| 7 | [III-A] 5 | [I-A] 0 | 102 | 0.13 |
| 8 | [III-A] 0 | [I-A] 3 | 106 | 0.12 |
| 9 | [III-A] 0 | [I-A] 5 | 97 | 0.14 |

EXAMPLE 4

Specimens were prepared in the same manner as in Example 2, except that sensitizing dyes shown in Table 4 were used. The sensitivity (relative value) and fog of each specimen obtained from the measured transmission density were as shown in Table 4. Dyes III-a and I-a were used as reference.

TABLE 4

| Specimen No. | Sensitizing dye and amount used (mg/m$^2$) | | Relative red sensitivity | Fog |
|---|---|---|---|---|
| 1 | [III-B] 4 | [I-A] 0 | 100 | 0.06 |
| 2 | [III-B] 2 | [I-A] 2 | 320 | 0.05 |
| 3 | [III-B] 0 | [I-A] 4 | 110 | 0.06 |
| 4 | [III-C] 4 | [I-A] 0 | 90 | 0.08 |
| 5 | [III-C] 2 | [I-A] 2 | 290 | 0 06 |
| 6 | [III-C] 0 | [I-A] 4 | 110 | 0.06 |
| 7 | [III-C] 4 | [I-B] 0 | 90 | 0.06 |
| 8 | [III-C] 2 | [I-B] 2 | 350 | 0 06 |
| 9 | [III-C] 0 | [I-B] 4 | 120 | 0.06 |
| 10 | [III-D] 4 | [I-E] 0 | 110 | 0.06 |
| 11 | [III-D] 2 | [I-E] 2 | 420 | 0.06 |
| 12 | [III-D] 0 | [I-E] 4 | 130 | 0.06 |
| 13 | [III-A] 4 | [I-B] 0 | 105 | 0.06 |
| 14 | [III-A] 2 | [I-B] 2 | 380 | 0.05 |
| 15 | [III-A] 0 | [I-B] 4 | 120 | 0.06 |
| 16 | [III-A] 2 | [I-a] 2 | 98 | 0.06 |
| 17 | [III-A] 0 | [I-a] 4 | 85 | 0.06 |
| 18 | [III-a] 4 | [I-A] 0 | 98 | 0.06 |
| 19 | [III-a] 2 | [I-A] 2 | 115 | 0.06 |

As is apparent from Table 4, as compared with the specimens 1, 3, 4, 6, 7, 9, 10, 12, 13 and 15, wherein sensitizing dyes were used each alone, the specimens 2, 5, 8, 11 and 14, wherein sensitizing dyes were used in combinations, showed markedly higher red sensitivities. The specimens 16 and 19, wherein reference dye I-a was used in combination with sensitizing dye III-A and reference dye III-a with sensitizing dye I-A, showed each a small increase in sensitivity compared with the specimens 3, 13, 17 and 18, wherein dyes were used each alone.

Reference dyes:

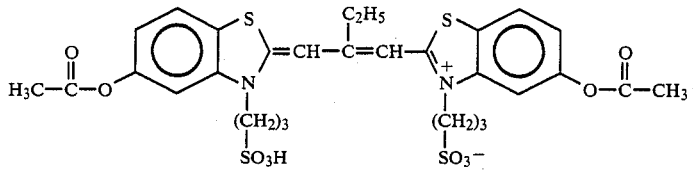

[III-a]

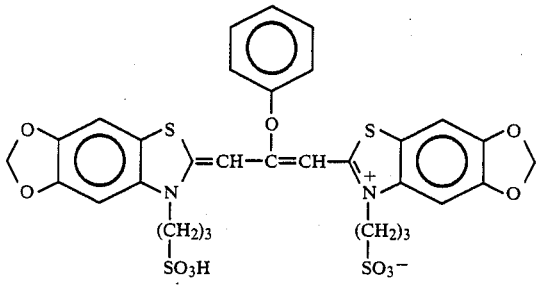

[I-a]

EXAMPLE 5

Specimens were prepared in the same manner as in Example 1, except that sensitizing dyes shown in Table 5 were used. The test results were as shown in Table 5, wherein the red sensitivity was assumed to be 100 when the sensitizing dye III-A was used in an amount of 2 mg/m². The silver coverage was 1.8 g/m².

TABLE 5

| Specimen No. | Sensitizing dye and amount used (mg/m²) | | Relative red sensitivity | Fog |
|---|---|---|---|---|
| 1 | [III-A] 2 | [II-A] 0 | 100 | 0.10 |
| 2 | [III-A] 1.5 | [II-A] 0.5 | 220 | 0.10 |
| 3 | [III-A] 1 | [II-A] 1 | 410 | 0.10 |
| 4 | [III-A] 0.5 | [II-A] 1.5 | 280 | 0.09 |
| 5 | [III-A] 0 | [II-A] 2 | 125 | 0.10 |
| 6 | [III-A] 3 | [II-A] 0 | 105 | 0.11 |
| 7 | [III-A] 5 | [II-A] 0 | 102 | 0.13 |
| 8 | [III-A] 0 | [II-A] 3 | 118 | 0.11 |
| 9 | [III-A] 0 | [II-A] 5 | 110 | 0.12 |

As is apparent from Table 5, as compared with specimens 1 and 5, wherein the sensitizing dye III-A or II-A was used alone, the specimens 2, 3, and 4, wherein sensitizing dyes were used in combinations, showed higher red sensitivities and lower fogs. The specimens 6, 7, 8 and 9, wherein sensitizing dye III-A or II-A was used in an increased amount, showed substantially no increase in sensitivity but higher fogs.

EXAMPLE 6

Specimens were prepared and treated in the same manner as in Example 2, except that sensitizing dyes shown in Table 6 were used. The test results were as shown in Table 6. The dyes II-a, III-b and III-c were used as reference.

TABLE 6

| Specimen No. | Sensitizing dye and amount used (mg/m²) | | Relative red sensitivity | Fog |
|---|---|---|---|---|
| 1 | [III-B] 4 | [II-A] 0 | 100 | 0.06 |
| 2 | [III-B] 2 | [II-A] 2 | 390 | 0.06 |
| 3 | [III-B] 0 | [II-A] 4 | 130 | 0.07 |
| 4 | [III-C] 4 | [II-A] 0 | 90 | 0.08 |
| 5 | [III-C] 2 | [II-A] 2 | 300 | 0.07 |
| 6 | [III-C] 0 | [II-A] 4 | 130 | 0.07 |
| 7 | [III-C] 4 | [II-C] 0 | 90 | 0.08 |
| 8 | [III-C] 2 | [II-C] 2 | 280 | 0.07 |
| 9 | [III-C] 0 | [II-C] 4 | 100 | 0.08 |
| 10 | [III-D] 4 | [II-E] 0 | 110 | 0.06 |
| 11 | [III-D] 2 | [II-E] 2 | 250 | 0.06 |
| 12 | [III-D] 0 | [II-E] 4 | 105 | 0.07 |
| 13 | [III-F] 4 | [II-F] 0 | 85 | 0.05 |
| 14 | [III-F] 2 | [II-F] 2 | 180 | 0 05 |
| 15 | [III-F] 0 | [II-F] 4 | 95 | 0.05 |
| 16 | [II-a] 2 | [II-A] 2 | 135 | 0.06 |
| 17 | [II-a] 4 | [II-A] 0 | 98 | 0.06 |
| 18 | [III-B] 2 | [III-b] 2 | 105 | 0.06 |
| 19 | [III-B] 0 | [III-b] 4 | 98 | 0.06 |
| 20 | [III-C] 2 | [II-a] 2 | 102 | 0.06 |
| 21 | [III-b] 2 | [II-E] 2 | 99 | 0.06 |
| 22 | [III-c] 2 | [II-F] 2 | 92 | 0.05 |
| 23 | [III-c] 4 | [II-F] 0 | 70 | 0 05 |

Reference dyes:

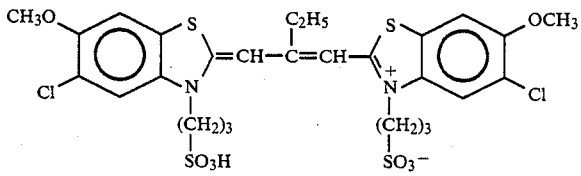

[II-a]

-continued

[III-b]

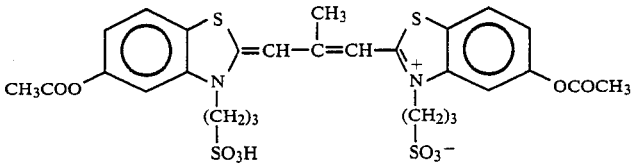

[III-c]

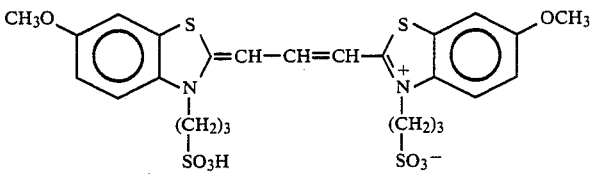

As is apparent from Table 6, as compared with specimens 1, 3, 4, 6, 7, 9, 10, 12, 13, and 15, wherein the sensitizing dyes were used each alone, the specimens 2, 5, 8, 11 and 14, wherein the dyes were used in combinations, showed a marked increase in red sensitivity. Specimens 16, 18, 20, 21 and 22, wherein reference dyes II-a, III-b and III-c were used in combination with I-c, II-E and II-F, showed a smaller increase in sensitivity compared with specimens 1, 3, 17, 18 and 23, wherein said dyes were used each alone.

What is claimed is:

1. A silver halide photograph emulsion containing a combination of the sensitizing dye represented by the general formula (I):

general formula (I):

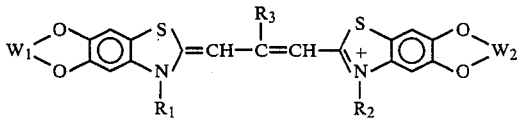

wherein $R_1$ represents an alkyl group, $R_2$ represents a sulfoalkyl group or a sulfoaralkyl group, and $R_3$ represents an alkyl group, and $W_1$ and $W_2$ represent each an alkylene group, and the sensitizing dye represented by the general formula (II):

general formula (II):

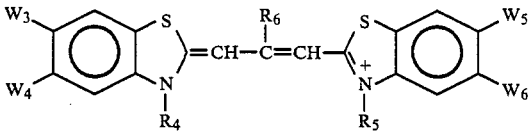

wherein $W_3$ to $W_6$ represent each an alkyl group, an alkoxy group, or hydroxyl group, $R_4$ represents an alkyl group, $R_5$ represents a sulfoalkyl group or a sulfoaralkyl group, and $R_6$ represents an alkyl group.

2. A silver halide photographic emulsion containing a combination of the sensitizing dye represented by the general formula (I):

general formula (I):

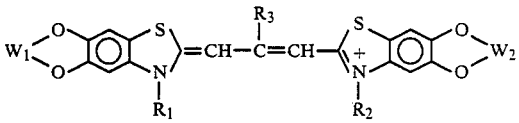

wherein $R_1$ represents an alkyl group, $R_2$ represents a sulfoalkyl group or a sulfoaralkyl group, and $R_3$ represents an alkyl group, and $W_1$ and $W_2$ represent each an alkylene group, and the synthesizing dye represented by the general formula (III):

general formula (III):

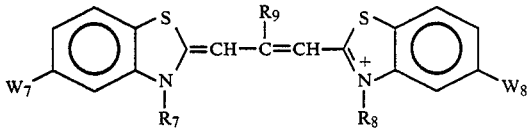

wherein $R_7$ represents an alkyl group, $R_8$ represents an sulfoalkyl group or a sulfoaralkyl group, $R_9$ represents an alkyl group, and $W_7$ and $W_8$ represents each an alkyl group, an alkoxy group, or hydroxyl group.

3. A silver halide photographic emulsion containing a combination of the sensitizing dyes represented by the general formula (I), (II) and (III):

general formula (I):

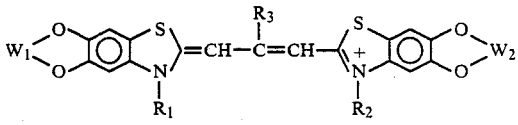

wherein $R_1$ represents an alkyl group, $R_2$ represents a sulfoalkyl group or a sulfoaralkyl group, and $R_3$ represents an alkyl group, and $W_1$ and $W_2$ represent each an alkylene group;

general formula (II):

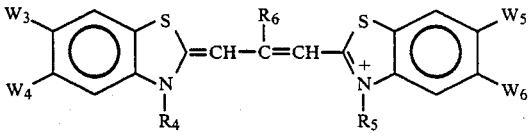

wherein $W_3$ to $W_6$ represent each an alkyl group, an alkoxy group, or hydroxyl group, $R_4$ represents an alkyl group, $R_5$ represents a sulfoalkyl group or a sulfoaralkyl group, and $R_6$ represents an alkyl group;

general formula (III):

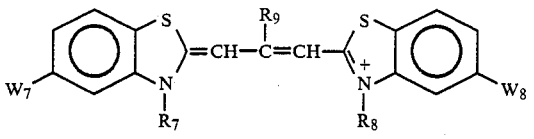

wherein $R_7$ represents an alkyl group, $R_8$ represents an sulfoalkyl group or a sulfoaralkyl group, $R_9$ represents an alkyl group, and $W_7$ and $W_8$ represents each an alkyl group, an alkoxy group, or hydroxyl group;

wherein at least one of $W_3$–$W_8$ of the dyes of the general formulas (II) and III) is an alkoxy group or a hydroxyl group.

4. A silver halide photographic emulsion according to claim 1, 2 or 3 wherein the sum of the sensitizing dyes is 0.01 to 10 g for 1 kg of silver halide in terms of silver nitrate.

5. A silver halide photographic emulsion according to claim 1 or 2 wherein the mixing ratio of sensitizing dyes in the combination of two dyes is in the range of from 1:0.1–10 in molar ratio.

6. A photosensitive material comprising a support and, provided thereon, a layer of the siver halide photographic emulsion according to claim 1, 2 or 3.

7. A process for the image formation which comprises imagewise exposing the photosensitive material of claim 6 and then developing it.

* * * * *